United States Patent [19]

Legille et al.

[11] Patent Number: 4,514,129

[45] Date of Patent: Apr. 30, 1985

[54] FURNACE CHARGING INSTALLATION

[75] Inventors: Edouard Legille, Luxembourg; Pierre Mailliet, Howald; Emile Lonardi, Bascharage, all of Luxembourg

[73] Assignee: Paul Wurth S.A., Luxembourg, Luxembourg

[21] Appl. No.: 355,531

[22] Filed: Mar. 8, 1982

[30] Foreign Application Priority Data

Apr. 3, 1981 [LU] Luxembourg ..... 83279

[51] Int. Cl.[3] ..... F23K 3/06

[52] U.S. Cl. ..... 414/200; 414/221; 222/503; 222/506; 222/545; 251/121; 251/212; 251/228; 251/301

[58] Field of Search ..... 414/169, 199, 200, 221; 222/476, 502, 503, 505, 506, 544, 545; 251/120, 121, 212, 228, 249.5, 250, 301

[56] References Cited

U.S. PATENT DOCUMENTS

| | | | |
|---|---|---|---|
| 2,785,840 | 3/1957 | Nave | 222/503 |
| 2,883,147 | 4/1959 | Mirza et al. | 251/301 |
| 3,704,992 | 12/1972 | Nieboer | 414/169 X |
| 4,074,835 | 2/1978 | Legille et al. | 414/200 X |
| 4,089,429 | 5/1978 | Stock et al. | 414/200 |
| 4,253,485 | 3/1981 | Legille | 137/315 |
| 4,300,724 | 11/1981 | Reynolds | 251/212 X |
| 4,322,197 | 3/1982 | Mahr et al. | 414/206 |

FOREIGN PATENT DOCUMENTS

| | | | |
|---|---|---|---|
| 1198840 | 8/1965 | Fed. Rep. of Germany . | |
| 1295487 | 5/1969 | Fed. Rep. of Germany . | |
| 2655983 | 7/1974 | Fed. Rep. of Germany . | |
| 2714933 | 10/1978 | Fed. Rep. of Germany | 251/212 |
| 2175452 | 10/1973 | France . | |
| 2317360 | 7/1976 | France . | |
| 2443653 | 7/1980 | France . | |
| 80113 | 8/1978 | Luxembourg . | |
| 82840 | 10/1980 | Luxembourg . | |
| 316601 | 8/1929 | United Kingdom . | |

*Primary Examiner*—Robert J. Spar
*Assistant Examiner*—Ken Muncy
*Attorney, Agent, or Firm*—Fishman & Dionne

[57] ABSTRACT

The delivery of charge material to the hearth of a pressurized blast furnace under the influence of gravity is accomplished without the necessity of changing the direction of material flow at a point exterior of the furnace. The rate of flow of the charge material, which moves in a vertical stream, is controlled by a metering device including a pair of overlapping register elements which define a variable size aperture which remains generally symmetrical with respect to the stream axis.

21 Claims, 16 Drawing Figures

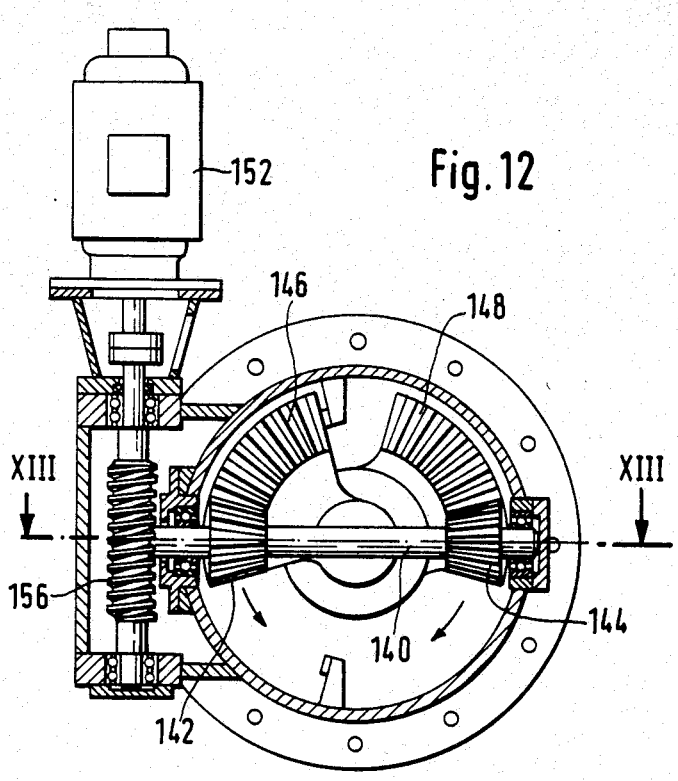
Fig. 12
Fig. 13
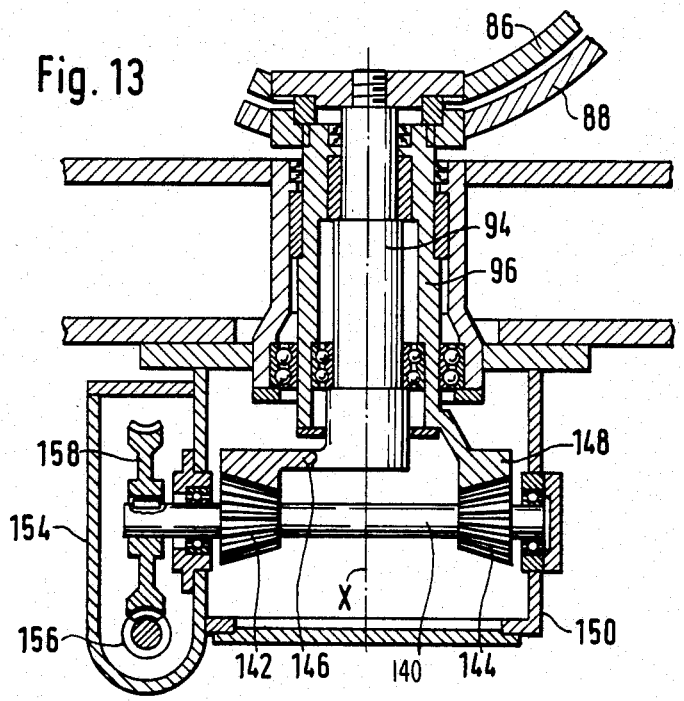

FURNACE CHARGING INSTALLATION

BACKGROUND OF THE INVENTION (1) Field of the Invention

The present invention relates to the exercise of control over the delivery of solid material to the interior of a pressurized vessel and particularly to the controlled delivery of charge material to the interior of an operating shaft furnace. More specifically, this invention is directed to apparatus for controlling the rate of flow of material being directed onto the hearth of a furnace and flowing under the influence of gravity. Accordingly, the general objects of the present invention are to provide novel and improved methods and apparatus of such character.

(2) Description of the Prior Art

The present invention is particularly well suited for use in a furnace charging installation of the type disclosed in U.S. Pat. No. 3,693,812 wherein a charge distribution member, in the form of a chute or spout, is supported for rotation in the throat of the furnace and is angularly adjustable relative to the longitudinal axis of the furnace. In the operation of a blast furnace, one of the parameters which is desirably controlled by the furnace operator is the profile of the charge material which is deposited upon the furnace hearth. The charge material profile may be accurately controlled through the exercise of control over the orientation of the distribution member of U.S. Pat. No. 3,693,812 and by exercising control over the rate at which the charge material is supplied to the distribution member. In order to permit continuous furnace operation, the material with which the furnace is to be charged will be temporarily stored in a sealable vessel positioned above the furnace throat, this intermediate storage vessel being alternately depressurized for loading and pressurized through a level of the furnace pressure for unloading into the furnace. When released from the temporary storage vessel, the furnace charge material will travel downwardly, under the influence of gravity, and will be guided through channels to the upper end of the charge distribution member. A metering device, to control the rate of flow of charge material, will be located along the flow path between the temporary storage vessel and the distribution member, the metering device being physically positioned above the top of the furnace to facilitate installation and service.

A prior art charge metering or flow control device of the type generally described above is disclosed in U.S. Pat. No. 4,074,835. It is to be noted that, in the prior art, the metering device has been installed in a channel or passage which was angularly inclined with respect to the furnace axis. The angularly inclined channel directed the charge material from the temporary storage vessel to the upper end of a vertically oriented feed channel which had its discharge end aligned with the upper end of the distribution member within the furnace.

The incorporation of the metering device in a channel or passage which is angularly oriented with respect to the furnace axis has precipitated a number of problems. For example, the rate of flow of the charge material was not uniform across the channel and, because of the angular orientation of the channel, the charge material did not fall vertically and symmetrically onto the uppper end of the distribution member. Previous attempts to solve these problems, to thereby permit more precise control of the furnace charging procedure, have included the installation of guide blades in the path of the charge material, was suggested in copending U.S. application Ser. No. 306,950, filed Sept. 30, 1981 and assigned to the assignee of the present invention, or the use of a tubular plug in the charge material flow path as suggested in U.S. Pat. No. 4,040,530. These previously proposed solutions to the problem of insuring a vertical and symmetrical flow of charge material at the upper end of the distribution member, which have not proved to be totally successful, constitute an effort to simulate the conditions which would exist if the intermediate storage vessel and its discharge orifice were coaxial with the furnace axis.

In prior furnace charging installations it was deemed impossible to locate the intermediate storage vessel on the furnace axis. One of the primary causes of this inability is the fact that, in order to enhance furnace operating efficiency, at least a pair of storage vessels were associated with each furnace. This arrangement has permitted the loading of one vessel during the period of time that the other vessel was discharging its contents into the furnace. Obviously, when a pair of juxtaposed temporary or intermediate storage vessels are employed, they cannot both be located on the furnace axis. Secondly, the metering devices presently available require, for operation, that the moving stream of solid charge material be penetrated at an oblique angle in order to reduce flow rate. Accordingly, even in those charging installations where a single intermediate storage vessel was utilized, for example an installation of the type shown in allowed copending application Ser. No. 62,969 filed Aug. 2, 1979, now U.S. Pat. No. 4,322,197, the storage vessel was located such that its axis was parallel to rather than coaxial with the furnace axis.

SUMMARY OF THE INVENTION

The present invention overcomes the above-briefly discussed and other deficiencies and disadvantages by providing a novel technique for exercising control over the delivery of solid material to the interior of a pressurized enclosure. The present invention also encompasses unique apparatus for use in the practice of the aforesaid method and particularly apparatus for use in the charging of a shaft furnace wherein an intermediate storage vessel is located coaxially with the furnace and a metering device, capable of regulating the rate of flow of vertically falling solid material, is located between the storage vessel and the furnace throat.

Apparatus in accordance with a preferred embodiment of the present invention comprises a furnace charging installation wherein an intermediate storage vessel, in the form of a hermetically sealable chamber, is mounted such that its discharge orifice is coaxial with the furnace axis. The apparatus further comprises a metering device which effectively controls the size of the vessel discharge orifice in such a manner that the orifice remains generally symmetrical with respect to the furnace axis.

Also in accordance with the preferred embodiment, the metering device is housed in a valve housing subassembly and is comprised of a pair of registers which have a generally spherical shape. Each of these registers is provided with a generally V-shaped cut-out and the registers are mounted so as to overlap whereby the cut-outs may be placed in registration. The registers are simultaneously movable in opposite directions so as to cause the cut-outs therein to define a delivery orifice of variable area which remains symmetrical with respect to the furnace axis.

In accordance with the present invention the metering device is preferably located at the lower end of short discharge conduit, extending from the base of the intermediate storage vessel, which is also coaxial with the furnace axis.

In one embodiment of the invention upper and lower sealing valves are associated with the intermediate storage vessel whereby the vessel may be alternately pressurized and depressurized. These sealing valves may be generally in the shape of spherical caps and the lower valve will be supported within the same housing as the metering device. In order to facilitate the filling thereof when in the depressurized condition, with the upper sealing valve open, a reservoir in the form of an open-topped feed or stand-by hopper may be mounted above the intermediate storage vessel and this hopper may, itself, be coaxial with the furnace. The hopper, if present will be provided with a retaining valve in its lower end to support the charge material when the upper sealing valve of the intermediate storage vessel is in the closed position.

In another embodiment of the invention the intermediate storage vessel may be surmounted by a further enclosure which, by virtue of the provision of upper and lower sealing valves, may itself be alternately pressurized and depressurized. The upper enclosure, when present, will be provided with a retaining valve to support charge material above the lower sealing valve of the said enclosure.

Regardless of whether the intermediate storage vessel is surmounted by an open-topped hopper or a pressurizable enclosure, the charge material retaining valve provided at the lower end thereof will preferably take the general form of the above-described metering device, i.e., the retaining valve will comprise either a single or double spherical register, except that the cut-outs will be eliminated. The retaining device and the reservoir discharge opening with which it is associated will preferably be as large as possible in the interest of transferring the contents of the hopper or enclosure to the intermediate storage vessel as rapidly as possible. If the intermediate storage vessel loading operation can be completed in not more than a few seconds, the total duration of a charging cycle employing the present invention will approximate that previously achieved through the use of a pair of juxtapositioned intermediate storage vessels which were operated in alternate fashion.

As noted above, in accordance with the preferred embodiment of the present invention the registers of the metering device, the retaining valves and the sealing valves all take the form of segments of a sphere, i.e., these elements are spherical caps. These spherical caps are rotatable about axes which are, in the case of the sealing valves, situated approximately on the level of the axis of rotation of the metering device or retaining valve with which the sealing valves are associated. This arrangement enables the sealing valves to be closely spaced to the cooperating metering device or retaining valve and thus enables the total height of the charging system to be reduced when compared to the prior art.

Also in accordance with the present invention, and partly as a result of the ability to closely space the sealing valves to the charge material flow control device with which they are associated, a sealing valve and the associated charge control device may be mounted within a common housing which can be removed from the charging installation as a unit and without disassembly of any of the apparatus.

In the preferred embodiment of the invention the registers of the metering device are supported at one side of the channel or passage with which the metering device is associated by means of a single shaft and, on the other side of this channel, by a pair of coaxial shafts.

The actuating mechanism for the metering device registers, in accordance with one embodiment of the present invention, comprises a sliding fork which is displaceable in a direction perpendicular to the pivot axis of the registers. This fork is provided with a pair of parallel racks which cooperate with sector gears integral with the coaxial support shafts of the registers.

In accordance with another embodiment the metering device register driving mechanism comprises a rotary shaft which is perpendicular to the pivot axis of the registers. This rotary shaft is driven by a motor via an endless screw and a wormwheel. The shaft supports a pair of conical pinions, respectively located on opposite sides of the register pivot axis, which cooperate with conical toothed sectors which are respectively integral with the coaxial rotatable support shafts of the registers.

The mechanisms for operating the sealing valves in accordance with the present invention produce a two-phase motion. During the first or longitudinal phase the spherical cap member is moved away from its cooperating valve seat and, during a second or transverse phase, the cap is pivoted about an axis which passes through its center of curvature and is moved out of the channel so as not to be impinged upon by the falling charge material. The valve closing operation will, of course, comprise the same two phases of motion performed in the reverse order.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which:

FIG. 12 is a cross sectional top view, partly in section, of a second embodiment of a metering device drive mechanism in accordance with the present invention;

FIG. 13 is a view taken along line XIII—XIII of FIG. 12;

DESCRIPTION OF THE PREFERRED EMBODIMENTS

Figure 1:
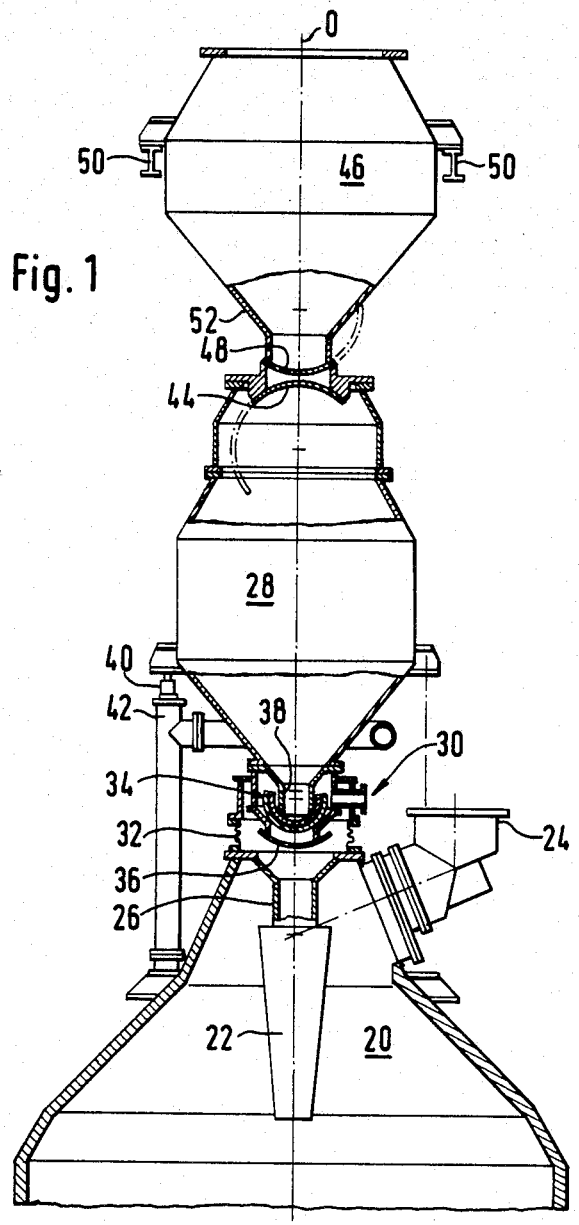
FIG. 1 is a schematic cross-sectional side elevation view of a furnace charging installation in accordance with the first embodiment of the present invention.
Figure 2:
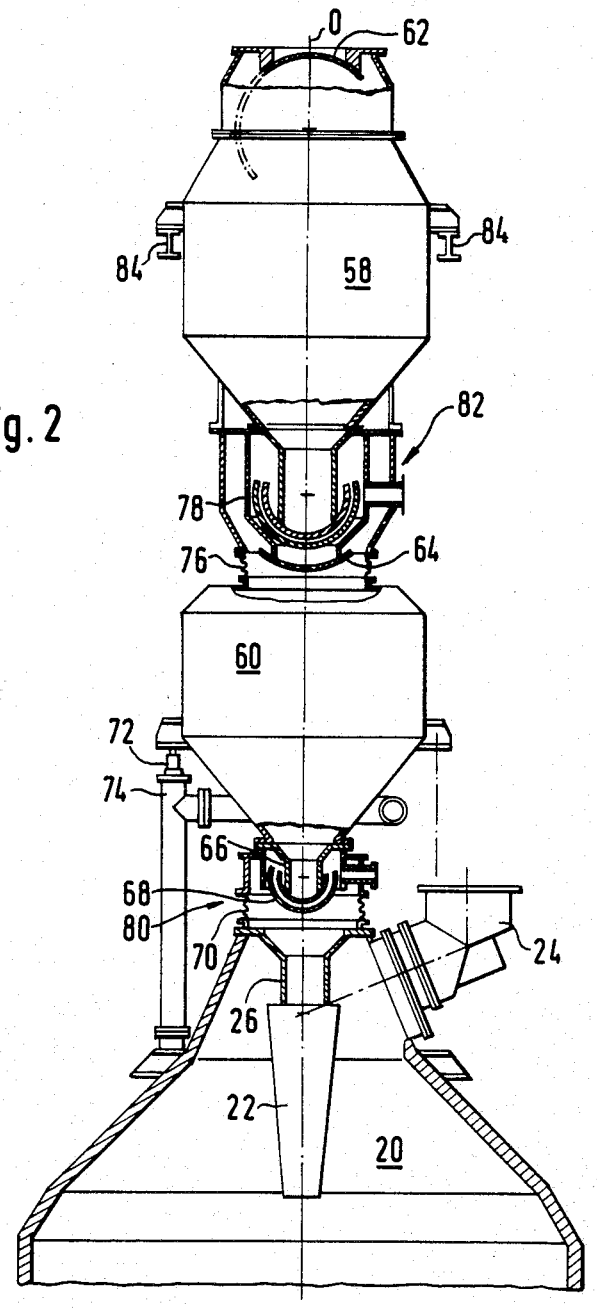
FIG. 2 is a view similar to FIG. 1 of a charging installation in accordance with a second embodiment of the invention.

With reference now to the drawing, shaft furnace charging installations in accordance with two embodiments of the present invention are respectively shown schematically in FIGS. 1 and 2. The charging installation is supported above the upper part or throat area of a shaft furnace 20 which will operate with a high counter-pressure. A rotatable and angularly adjustable distribution member, in the form of a spout 22, is suspended within the furnace. The aiming of the spout 22 is controlled by a mechanism 24 so that the material with which the furnace is to be charged, the said material being controllably released from the charging installation, will be directed by spout 22 onto the furnace hearth so as to achieve the desired charge profile on the hearth. A short central feed channel 26, the upper part of which has a funnel shape, is positioned within the furnace immediately above spout 22 and insures that the charge material delivered into the furnace will be directed onto the upper end of the spout.

The charging installation of FIG. 1 comprises a vessel 28 which is coaxial with and supported above furnace 20. In order to permit vessel 28 to be loaded with the furnace charge material and subsequently to discharge its contents into the pressurized furnace, upper and lower sealing valves, respectively indicated at 44 and 36, are provided in order to permit vessel 28 to be alternately pressurized and depressurized. A valve cage or housing, indicated generally at 30, is positioned between the lower or discharge end of vessel 28 and the top of the furnace as defined by the open upper end of feed channel 26. The lower sealing valve 36 and a charge metering device 34 are positioned within valve housing 30. The metering device 34, in the manner to be described below, regulates the outflow of charge material from vessel 28 via a discharge conduit 38 which is coaxial with vessel 28 and forms a prolongation of the open lower end thereof.

As noted above, vessel 28 and its discharge conduit 38 are coaxial with the furnace axis 0. The metering device 34 defines a variable size opening which is generally symmetrical about axis 0. Charge material being delivered to the furnace will fall directly from vessel 28 onto the upper end of spout 22 and the stream of falling charge material will be symmetrical with respect to the furnace axis. The discharge of material from vessel 28, therefore, always takes place in the same manner and the prior art charging process control problems resulting from a lack of symmetry due to an angled and eccentric flow of the charge material are eliminated.

The nature of the control exercised over the metering device 34 will be a function of the furnace charging requirements and the contents of vessel 28. In order to permit knowledge of the contents of vessel 28, the vessel is either continuously or intermitently weighed. In order for the weighing to occur, vessel 28 must be suspended above rather than being rigidly attached to furnace 20 and this necessitates that the valve housing 30 must include a peripheral compensator 32 which will provide a hermetic seal while permitting a limited degree of movement of vessel 28 along the furnace axis 0. The weighing of vessel 28 is effected by means of a number of sensors 40, which may for example comprise strain gauges, on which the vessel is supported. In the typical instance there will be three sensors 40 which are mounted at the top of upright structural members 42 which form part of the furnace superstructure.

During the charging of the furnace the upper sealing valve 44 will be closed, the lower sealing valve 36 will be open, the metering device 34 will be at least partly opened and the pressure in vessel 28 will be approximately equal to that prevailing within the furnace. As a result of the pressurization, a lifting force proportional to the cross-sectional area of compensator 32 will be applied to vessel 28. In order to compensate for the effects of this lifting force on the weight related signals provided by sensors 40, and also to avoid the possibility of negative readings, the sensors 40 are prestressed by an amount equal to or greater than the lifting force.

In order to enhance the efficiency of a charging operation performed with the embodiment of FIG. 1, a stand-by hopper 46 is supported above vessel 28. Hopper 46 will be loaded with charge material during those periods that upper sealing valve 44 is closed such as, for example, when vessel 28 is discharging its contents into furnace 20. The lower end of hopper 46 terminates in a delivery conduit 52. A retaining valve 48 is provided at the lower end of conduit 52. The retaining valve 48 supports the material in hopper 46 when the sealing valve 44 is closed. To insure that the charge material will be transferred as rapidly as possible from hopper 46 into vessel 28, the cross-sectional area of delivery conduit 52 is made as large as possible. In order to insure that the weight of hopper 46 will not be reflected in readings obtained when vessel 28 is weighed, the hopper is supported on beams 50 and there is a total separation of the hopper from the vessel 28 immediately below the retaining valve 48.

The various phases which constitute a charging cycle, and the inter-relationships between these different phases, are explained in detail in above-referenced application Ser. No. 62,969, now U.S. Pat. No. 4,322,197 wherein a furnace charging installation utilizing a single intermediate storage vessel surmounted by a stand-by hopper is described.

In the embodiment illustrated in FIG. 2 the intermediate or temporary storage vessel is indicated at 60 and, as in the embodiment of FIG. 1, is coaxial with furnace 20. A further storage vessel 58, provided with an upper sealing valve 62 and a lower sealing valve 64, is mounted above vessel 60. The metering of the flow of charge material into the furnace is, in the FIG. 2 embodiment, effected by means of a metering device 68 which will be identical to the metering device 34 of the embodiment of FIG. 1. The metering device 68 controls the flow of charge material through a discharge conduit 66 which forms an extension of the open lower end of vessel 60. The metering device 68 is positioned within a valve housing which is indicated generally at 80.

As in the embodiment of FIG. 1, the intermediate storage vessel 60 functions as a weighing hopper and thus is supported on a plurality of sensors 72 mounted on uprights 74 of the furnace superstructure. Also, the vessel 60 is hermetically coupled to the furnace by means of a compensator 70. Vessel 60 is also hermetically coupled to the vessel 58 by a second flexible compensator 76. By making the section of compensator 76 equal to that of compensator 70, the lifting forces due to the counter-pressure will be balanced out and thus will not effect the results of the weighing operation. Accordingly, in the FIG. 2 embodiment it is not necessary to prestress the sensors 72.

As noted above, while only single sensors have been shown for weighing the intermediate storage vessel, in both of the embodiments of FIGS. 1 and 2 there will typically be three such sensors located at intervals of 120° around the vessel.

Continuing to discuss the FIG. 2 embodiment, the vessel 58 is supported on beams 84. Communication between the interior of vessels 58 and 60 is afforded by means of a retaining valve 78 which is opened when the sealing valve 64 is open. The retaining valve 78 may be of the same construction as the metering device 68. As shown in FIGS. 1 and 2, and as will be described in greater detail below, this construction will consist of a pair of cooperating registers. Where these cooperating registers are to perform a metering function they will be provided with cut-outs of appropriate size and shape. However, when the registers are to perform merely a retaining function they will be of continuous construction. It is, of course, also possible to employ a single element retaining valve, such as the valve 48 of the FIG. 1 embodiment, in the embodiment of FIG. 2 and vice versa.

The upper sealing valve 64 and the retaining valve 78 of the FIG. 2 embodiment are positioned within a valve housing which has been indicated generally at 82. This housing is removable as a complete unit. This is also true of the housing 30 of FIG. 1 and housing 80 of FIG. 2, removal being accomplished by disconnecting the unit and sliding it to the side together with the discharge conduits at the lower ends of the intermediate storage vessels. The valve housings will be described in greater detail below in the discussion of FIGS. 3 and 4.

The embodiments of FIGS. 1 and 2 are both characterized by the positioning of the intermediate storage vessel coaxially with the furnace. These two embodiments share the common advantage of the elimination of the movement of the descending charge material at an angle with respect to the furnace axis. Additionally, the unbalanced forces which are exerted on the furnace superstructure as a result of the pressurization of an off-axis storage vessel are eliminated. The embodiment of FIG. 1 has, when compared to the FIG. 2 embodiment, a lower overall height due to the fact that the hopper 46 is open-topped. Thus, in the FIG. 1 embodiment there is no need for the upper sealing valve 62 of the FIG. 2 embodiment. It is also to be noted that the open-topped hopper of the FIG. 1 embodiment may be easily filled through the use of skips or a conveyor. The FIG. 2 embodiment, on the other hand, eliminates the need for prestressing the strain gauges employed in the weighing operation.

A further advantage common to both of the embodiments of FIGS. 1 and 2 resides in the fact that the design of the sealing valves and metering devices permits a very compact construction for the valve housings in which these devices are mounted. Thus, as will become apparent from the discussion below, the shape of the registers which form the metering devices correspond to the shape of the sealing valves and the axes of rotation of both of the registers and of the valves are situated approximately at the same level.

Figure 4:
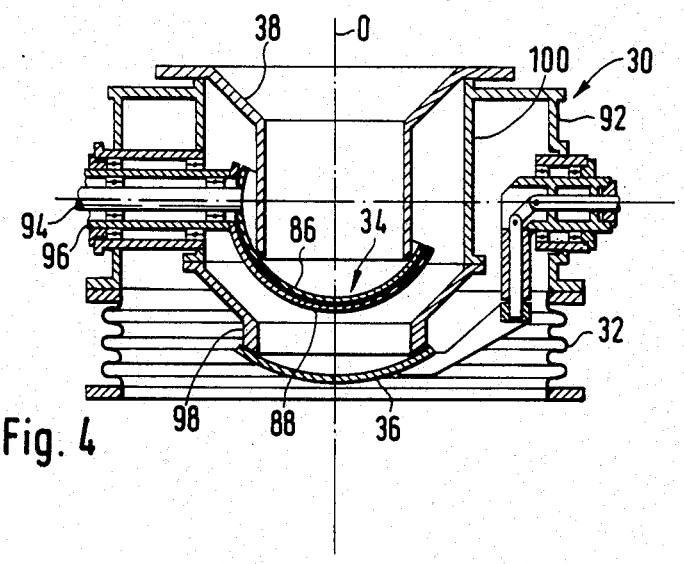
FIG. 4 is a schematic side-elevation view taken along line IV—IV of FIG. 3.
Figure 3:
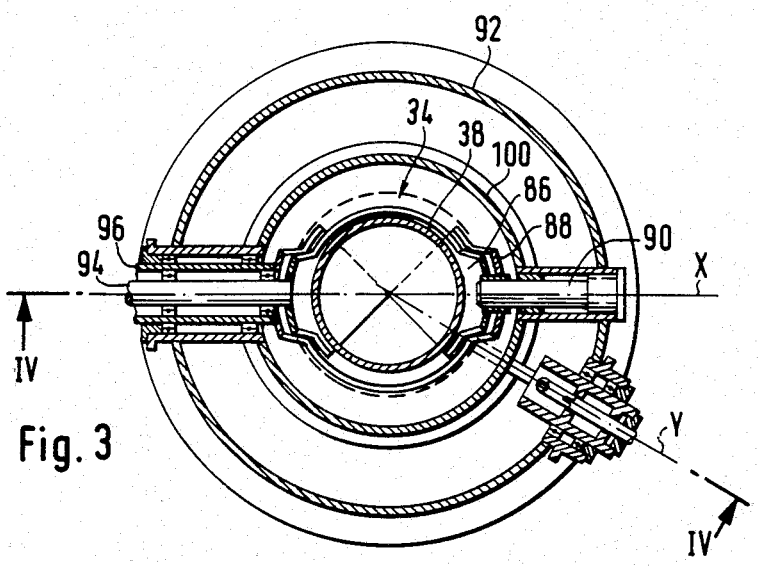
FIG. 3 is a schematic cross-sectional top plan view through a metering device-sealing valve subassembly in accordance with the present invention.

Referring now to FIGS. 3 and 4, the valve housing 30 and the components located therein are disclosed in greater detail. The metering device 34 comprises a pair of registers 86 and 88 with concentric spherical curvature. The center of curvature of registers 86 and 88 is situated at the intersection of their pivot axis, indicated at X in FIG. 3, and the axis 0 of the furnace. The registers 86 and 88 are supported at one side of the valve housing on the same pivot shaft 90 which is mounted in the wall 92 of housing 30. On the side of housing 30 diametrically opposed to shaft 90 the upper register 86 is affixed to a shaft 94 which passes coaxially through a hollow shaft 96. The lower register 88 is affixed to shaft 96. The two coaxial shafts 94 and 96 can rotate relative to each other and relative to the wall 92 of housing 30, suitable bearings being provided to permit such rotation. Suitable shaft seals are, of course, also provided in order to insure the necessary hermeticity of the interior of housing 30.

It should be noted that the single support shaft 90 of FIG. 3 cannot be seen in FIG. 4 since FIG. 4 is not a diametric section but a section along the broken line IV—IV.

The sealing valve 36, which is also positioned within the housing 30, is applied against a valve seat 98 affixed to the lower end of a conduit 100 when in the closed position. The conduit 100 is coaxial with and surrounds the discharge conduit 38 of the intermediate storage vessel. The valve 36, like the registers 86 and 88, has the shape of a spherical cap. The center of curvature of valve 36 is also situated at the intersection of axes 0 and X. The axis of rotation Y of valve 36 is at a predetermined angle with respect to the axis of rotation of the registers comprising the metering device 34. The angle between axes X and Y results from the necessity of providing space for the movement of the various components of the drive mechanism and preventing impact against the shaft 90.

The sealing valve 36 is supported from the wall 92 of housing 30 by a drive means which will be described in greater detail below. This drive means causes valve 36 to pivot about axis Y during movement between the closed position shown in FIG. 4 and a "storage position" in which the valve member is located in the annular space between conduit 100 and wall 92 of housing 30. The registers 86 and 88 are similarly driven, by means which will be described in detail below, to cause them to simultaneously rotate in opposite directions about axis X. During such movement the registers move from the closed position shown in FIG. 4 to a full open position wherein they are disposed in the annular space between the conduits 38 and 100. The operation of the registers 86 and 88 will be further described below in the discussion of FIGS. 5–8.

Figure 5:
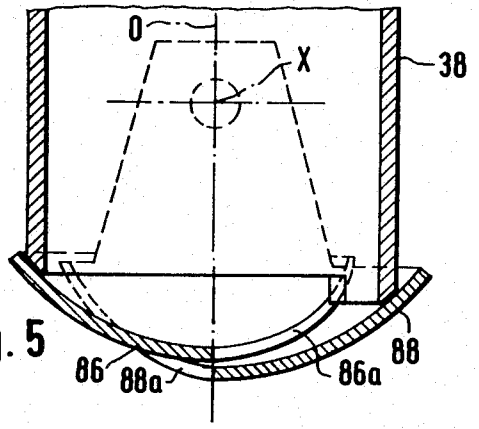
FIG. 5 is a schematic side-elevation view representing a metering device in accordance with the present invention in the closed condition.
Figure 6:
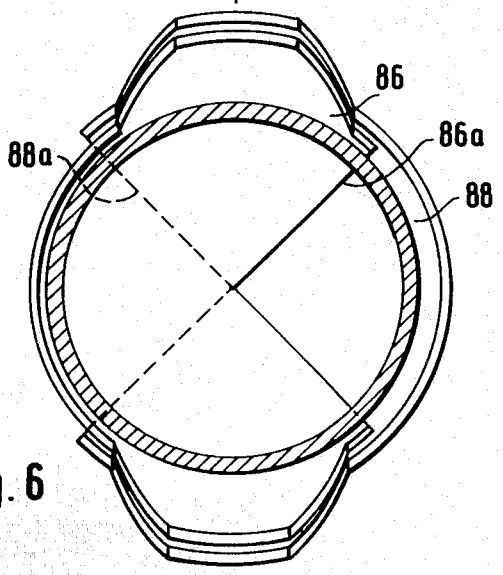
FIG. 6 is a schematic top view of the closed valve of FIG. 5.

Turning now to FIGS. 5–8, a metering device in accordance with a preferred embodiment of the present invention is shown schematically in various operational positions. Thus, in FIGS. 5 and 6 the registers 86 and 88 comprising the metering device are shown in the closed position. The registers 86 and 88 each have the shape of a spherical cap, i.e., a segment of a sphere. Register 86 is provided with generally a V-shaped cut-out portion 86*a* while register 88 is provided with a similarly shaped cut-out 88*a*. These cut-out portions 86*a* and 88*a* are symmetrical relative to the same diametric plane. Also, the cut-out portions of the registers are situated on the side of each register which constitutes the "attack" side thereof, i.e., the register which first penetrates the stream of material descending downwardly in the conduit 38 when moving from the full open position toward the closed position. Further, in order to permit a complete closing of the conduit 38, the cut-outs must not be deeper than the radius of conduit 38. As shown in FIGS. 5 and 6, with the metering device in the closed or no-flow position, the cut-out portion 86*a* of the upper register 86 completely overlies a solid portion of register 88 while the cut-out portion 88*a* of register 88 is completely covered by a solid part of register 86. When the metering device is in the closed position, the cut-out portions must diverge from the central region toward the edges of the registers. It is not, however, necessary for the sides delimiting each of the cut-out portions to extend along a straight line. Thus, considering a plan view of the register, the sides of the cut-outs may be slightly curved relative to the edges in order to define an optimum geometrical shape of the discharge aperture.

Figure 7:
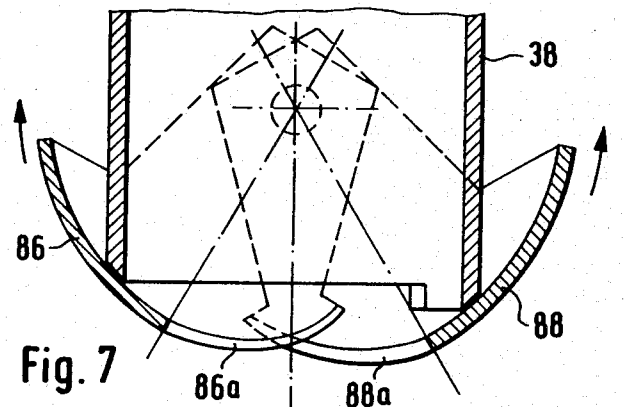
FIG. 7 is a view similar to FIG. 5 with the metering device shown in the partly opened condition.
Figure 8:
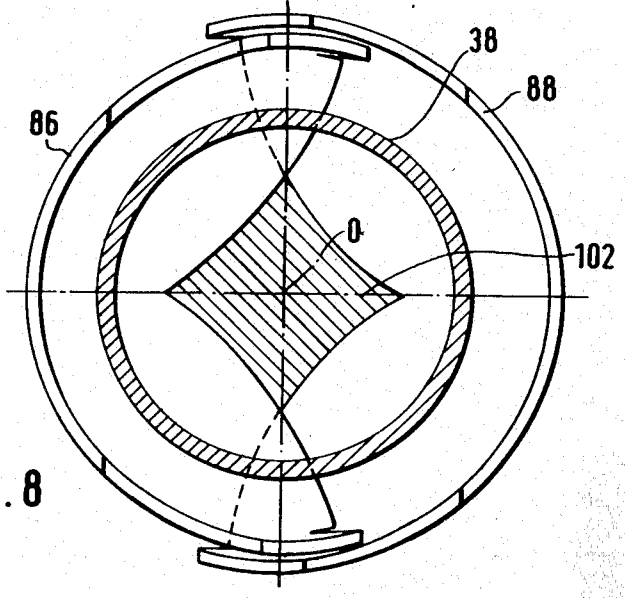
FIG. 8 is a view similar to FIG. 6 showing the metering device in the condition depicted in FIG. 7.

FIGS. 7 and 8 depict the opening of the registers of the metering device. Thus, as may be seen from FIGS. 7 and 8, when the registers 86 and 88 are pivoted in opposite directions in accordance with the arrows on FIG. 7 the solid parts of the registers move apart while the cut-out portions 86*a* and 88*a* come into registration to determine the discharge aperture cross-section. Thus, comparing FIGS. 6 and 8, the rotation of the registers 86 and 88 in the direction of the arrows of FIG. 7 causes the metering device to go from the full closed position of FIG. 6 to the partially open position of FIG. 8. As the metering device opens an aperture having the generally diamond-shape indicated by cross hatching in FIG. 8 will be formed. It is important to note that the registers 86 and 88 define a flow control opening, through which the charge material will be discharged from the intermediate storage vessel, which may be varied in size but which at all times will be symmetrical with respect to the axis 0 of the furnace. As previously noted, the geometrical shape of the opening through which the furnace charge material passes may be varied by changing the shape of one or both of the cut-out portions 86*a* and 88*a* in the registers. Thus, by way of example, instead of a diamond-shaped opening with concave sides, as depicted in FIG. 8, a diamond-shape with convex sides, tending toward a circle, can be achieved.

Figure 9:
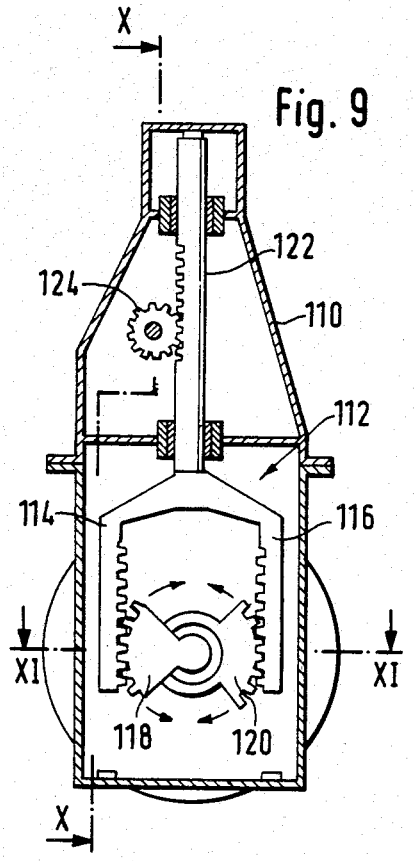
FIG. 9 is a schematic side-elevation view, partly in section, depicting a metering device drive mechanism in accordance with a first embodiment of the present invention.
Figure 10:
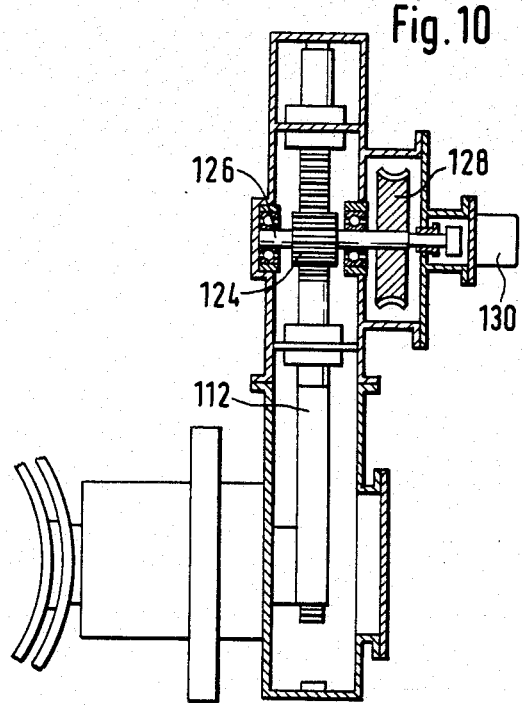
FIG. 10 is a side-elevation view taken along line X—X of FIG. 9.
Figure 11:
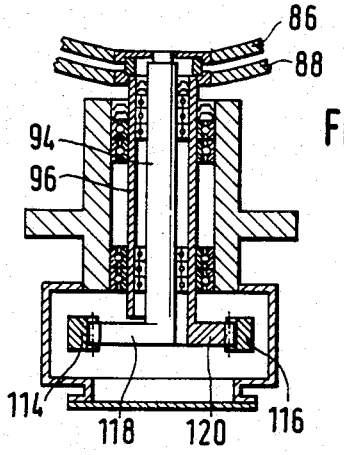
FIG. 11 is a view taken along line XI—XI of FIG. 9.

FIGS. 9–11 are a schematic view of a first embodiment of a drive mechanism for actuating the two registers of a metering device in accordance with the present invention simultaneously and in opposite directions. This drive mechanism is positioned within a housing 110 which is mounted outside of the valve housings 30, 80 and 82. The drive mechanism comprises a sliding fork 112 supported for motion along its longitudinal axis, i.e., perpendicular to the axis of rotation of the coaxial shafts 94 and 96 (FIGS. 3 and 4). The branches 114 and 116 of fork 112 have, formed integral therewith, gear teeth which define a pair of parallel racks. The rotatable shafts 94 and 96 have, affixed thereto, sector gears, a sector 118 being integral with shaft 94 and a sector 120 being integral with shaft 96. The sectors 118 and 120 are engaged by the racks on branches 114 and 116 respectively of fork 112 and, accordingly, movement of the fork 112 along the axis of its shank or handle portion 122 will cause the registers 86 and 88 to be rotated synchronously and in opposite directions, the direction of rotation being dependent upon the direction of movement of fork 112.

Motion is imparted to fork 112 by means of providing the shank portion 122 thereof with a further integral rack which is engaged by a pinion gear 124. Gear 124 is integral with a shaft 126 supported, as shown in FIG. 10, in bearings in housing 110. Rotatable shaft 126 is driven by a motor, not shown, via an endless screw assembly which includes a wormwheel 128. A mechanism 130, located to the exterior of housing 110, is also connected to shaft 126 and simulates and reproduces the movement of the registers 86 and 88 for the purpose of monitoring and controlling the operation of the metering device 34. It is to be noted that motion may be imparted to fork 112 by means other than the motor and gear drive of FIGS. 9 and 10 such as, for example, a hydraulic jack, a screw-threaded rod, etc.

A second embodiment of a drive mechanism for the registers 86 and 88 of the metering device 34 is depicted in FIGS. 12 and 13. The drive mechanism of FIGS. 12 and 13 includes a drive shaft 140 which supports a pair of conical pinion gears 142 and 144. The pinions 142 and 144 are situated at opposite ends of a prolongation of the pivot axis X of the registers. The pinion 142 engages a conical toothed sector 146 integral with shaft 94 while pinion 144 engages a conical toothed sector 148 which is integral with shaft 96. Since the cooperating gears 142–146 and 144–148 are situated at opposite sides of axis X, as clearly shown in FIG. 13, the rotation of drive shaft 140 will result in the rotation of shafts 94 and 96 in the opposite directions. The drive shaft 140 is supported by means of suitable bearings provided in the wall of a hermetically sealed housing 150. Movement is imparted to shaft 140 by means of an electric motor 152 located externally of the housing, the output shaft of motor 152 being coupled to shaft 140 by means of an endless screw 156 and a wormwheel 158, the screw 156 and wormwheel 158 defining a reduction gear system positioned within a separate housing 154.

It will be obvious to those skilled in the art that the interior of the valve housing must, in all embodiments of the present invention, be hermetically sealed. This sealing may be accomplished either in the wall of the valve housing itself, i.e., between the valve housing and the housing for the drive mechanisms for actuating the registers of the metering device, and/or in the external wall of the drive mechanism housing. In the latter case the housing for the drive mechanism will be subjected to the pressure prevailing within the furnace.

Figure 14:
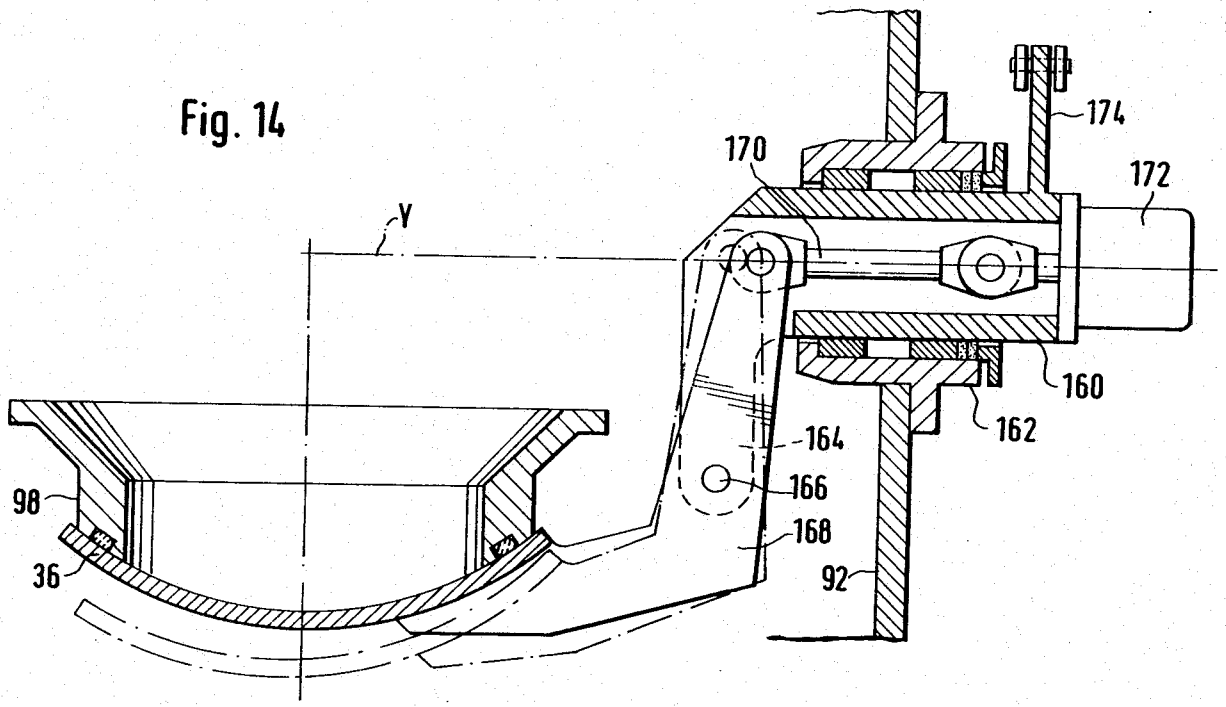
FIG. 14 is a schematic side elevation view of a sealing valve actuating mechanism in accordance with a first embodiment of the present invention.

FIG. 14 depicts a first embodiment of an actuating system for a sealing valve, for example sealing valve 36 of FIG. 1, in accordance with the present invention. The sealing valve actuating mechanism comprises a tubular support 160 mounted for rotation about axis Y in a bearing system 162 which extends through the wall 92 of the valve housing 30. At the interior of the valve housing the rotary support 160 is coupled to the valve member 36 by means of a linkage comprising an extension 164 of support 160, pivot connection 166 and an arm 168. A first end of arm 168 is rigidly affixed to the valve member 36 while the other end of arm 168 is articulated to a rod 170 which extends through the tubular support 160. The arm 168 is also pivotally attached to extension 164 by pivot 166. The rod 170 is caused to perform an axial longitudinal movement by means of an actuator 172 which may comprise an electric, hydraulic or pneumatic motor. The rotatable support 160 is connected, at the exterior of the valve housing, to an actuator by means of an arm 174. This actuator may comprise a hydraulic jack, endless screw or any other suitable means for causing the support 160 to rotate about the axis Y.

The operation of opening the valve 36 consists of a first phase wherein the valve member is displaced, in a generally longitudinal direction, from the valve seat 98. This is accomplished by actuating the motor 172 to cause the rod 170 to be displaced from the position shown in solid lines to the position shown in broken lines. This movement causes the valve 36 to rotate, under the influence of the motor and its own weight, about the pivot 166. Once the valve member 36 has been displaced from the valve seat, the entire mechanism including the valve member 36, arm 168 and tubular support 160 are rotated about axis Y by imparting motion to arm 174. This will cause the valve 36 to move to a "storage" position between the conduit 100 and the housing wall 92 (see FIG. 4). The process of closing the sealing valve consists of the same operations performed in the reverse order, i.e., the rotation of support 160 about axis Y followed by a translational movement of rod 170 to the right as the apparatus is depicted in FIG. 14.

Figure 15:
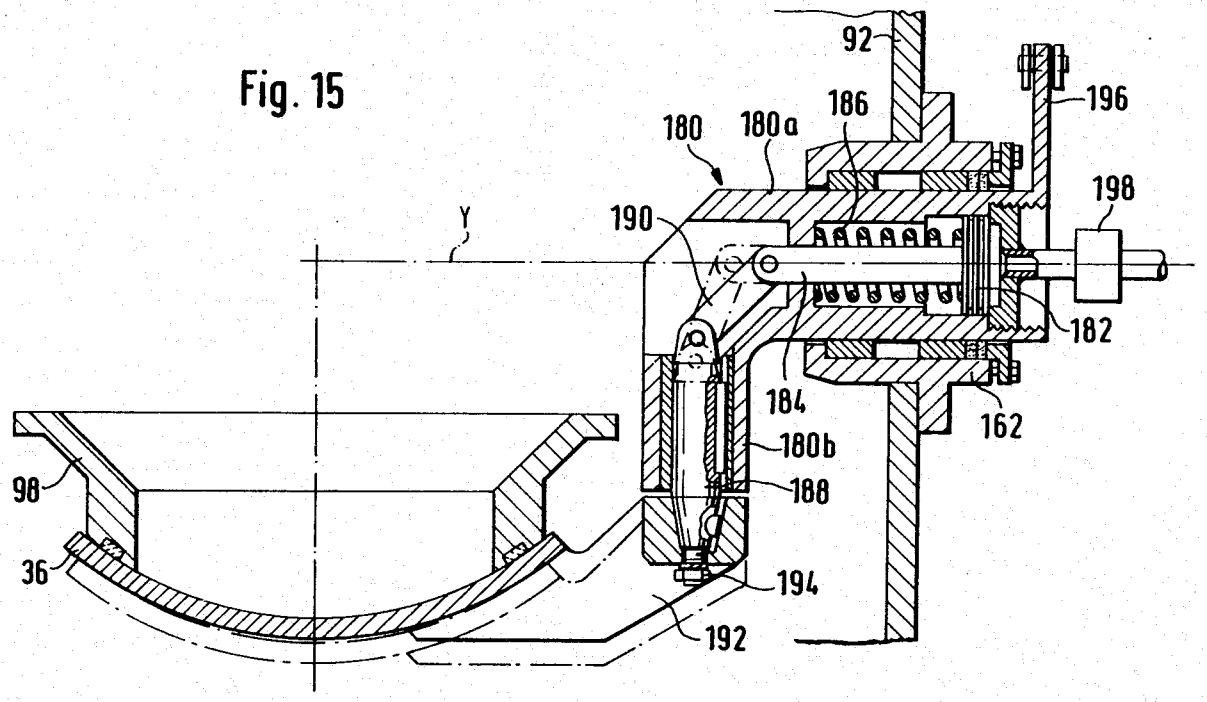
FIG. 15 is a view similar to FIG. 14 depicting a second embodiment of a sealing valve actuating mechanism in accordance with the present invention.

The sealing valve actuating mechanism of FIG. 15 comprises an L-shaped pivotal support, indicated generally at 180, having a first branch **180*a* mounted in the wall 92 of the valve housing for rotation, in a bearing system 162, about axis Y. A hydraulic actuator comprising a piston 182 is mounted within the branch 180*a* of support 180. Piston 182 is biased to the position shown, commensurate with the sealing valve being closed, by means of a spring 186. The piston rod 180 of the hydraulic actuator extends along axis Y, through the center of spring 186, and is pivotally connected to the first end of a linkage 190. The second branch 180*b* of support 180 is also of tubular construction and houses a slide member 188. Suitable means are provided to prevent relative rotation between the slide member 188 and the branch 180*b* of support 180. The upper end of slide 188 is articulated to the second end of the linkage 190. The second or lower end of slide 188 is connected to an arm 192 which, in turn, is affixed to the valve member 36. The connection between the slide member 188 and arm 192 is releasable, this detachable connection being symbolized by the nut 194, and is anti-gyratory in order to avoid any relative rotation between arm 192 and slide 188**.

The branch **180*a* of support 180 is, at the exterior of the valve housing, provided with an integral arm 196. Arm 196 will be actuated, in order to cause rotation of the support about axis Y, by means of a hydraulic jack or other drive mechanism, not shown. A rotatable fluid connection, indicated at 198, will enable the actuation of piston 182 without impeding the rotation of support 180. Thus, the delivery of pressurized fluid to the interior of the cylinder defined in branch 180*a* of support 180 via the rotatable connection 198 will overcome the bias of spring 186 and displace piston 182 to the left as the apparatus is depicted in FIG. 15. The movement of piston 182 is transmitted, via piston rod 184, to linkage 190. The actuation of piston 182 may, because of the rotatable connection 198, be maintained while the support 180 is being rotated. The operation of opening the valve 36 comprises, as in the embodiment of FIG. 14, an initial phase wherein the valve 36 is moved away from the valve seat 98. This initial opening phase is accomplished by imparting movement to piston 182 and will cause the linkage 190, slide member 188, arm 192 and valve member 36 to move from the position shown in solid lines to that shown in broken lines. With the valve member 36 displaced from the valve seat, torque will be applied to arm 196 to rotate the support 180 and valve 36 about axis Y to move the valve member into the "storage" position. The closing operation is, of course, comprised of the same movements performed in the reverse order. During the closing operation, when the valve member 36 reaches the position shown in broken lines, the hydraulic pressure behind piston 182 is reduced thereby allowing the spring 186 to return the piston 182 to the position shown in FIG. 15. During this spring induced movement the slide 188 will move upwardly thus causing the valve 36 to be reseated against the valve seat 98. Obviously, for the actuator of FIG. 15 to perform properly, the force exerted by spring 186 must be greater than the gravitational force exerted on the end of the piston rod 184 by the combined weight of valve member 36, arm 192, slide member 188 and linkage 190**.

Figure 16:
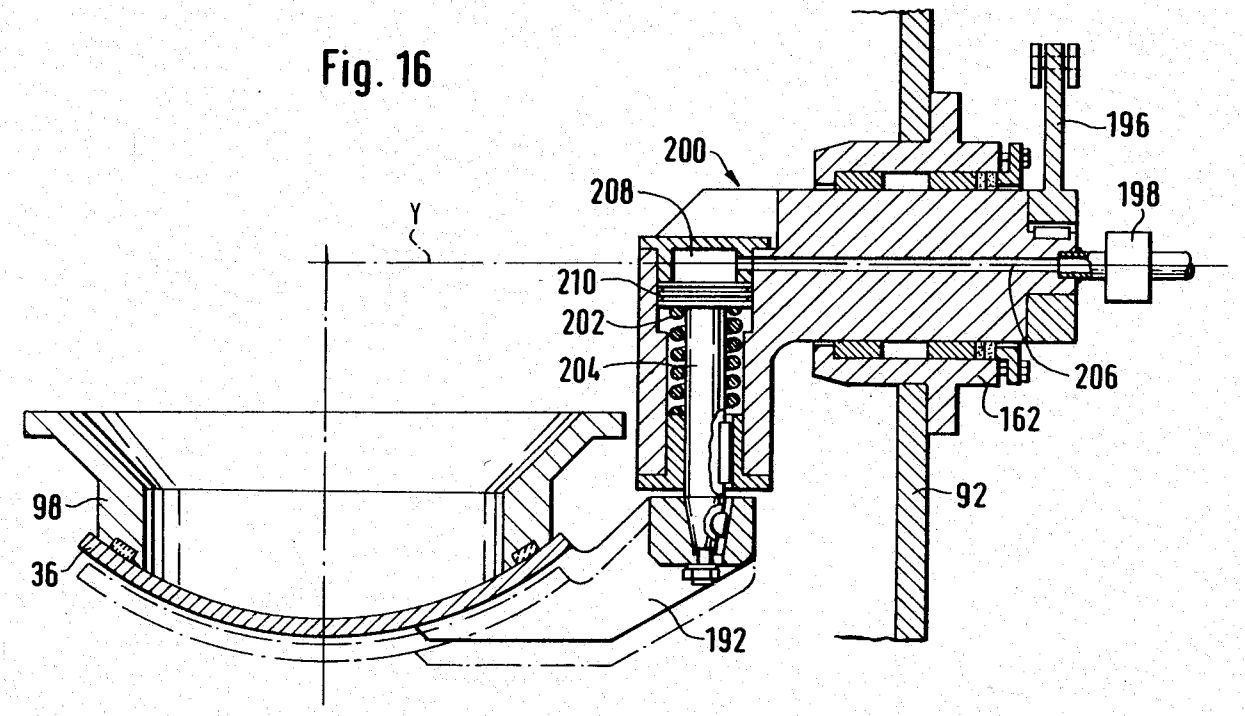
FIG. 16 is a view similar to FIGS. 14 and 15 depicting a third embodiment of a sealing valve actuating mechanism in accordance with the present invention.

FIG. 16 illustrates a third embodiment of a sealing valve actuating mechanism in accordance with the present invention. The apparatus of FIG. 16 is similar to that of FIG. 15 and thus the same reference numerals have been employed in FIGS. 15 and 16. In FIG. 16 an L-shape pivoting support, indicated generally at 200, is supported in the wall 192 of the valve housing by means of a bearing system 162. Rotation is imparted to support 200 by means of an arm 196 which is affixed thereto at a point to the exterior of the valve housing. The branch of support 200 which is positioned within the housing defines a hydraulic actuator having a cylinder 208 and a piston 210 which is capable of movement in a direction which is perpendicular to axis Y. The piston 210 is biased, by means of a spring 202 to the position shown which corresponds to the sealing valve being in the closed condition. Hydraulic fluid for operating the hydraulic actuator is delivered to the cylinder by means of a rotatable coupling 198, located to the exterior of the valve housing, and a passage 206 which extends along the axis of rotation of support 200. A piston rod 204 extends from piston 210 and performs the function of the slide member 188 of the FIG. 15 embodiment, the end of the piston rod being removably attached to the arm 192 to which the valve member 36 is affixed. Relative rotation between arm 192 and piston rod 204 will be prevented in any suitable manner as will rotation between piston rod 204 and the branch of the support 200 in which it moves.

In the operation of the FIG. 16 embodiment the delivery of pressurized fluid to cylinder 208 will produce sufficient force to overcome the bias of spring 202 and cause piston 210 to move downwardly. This motion will result in the valve member 36 moving from the position shown in solid lines to the position shown in broken lines. Once the valve member is displaced from the valve seat, torque will be applied to arm 196 to cause the valve member 36 to be pivoted into the "storage" position. The closing operation of the valve of the FIG. 16 embodiment will consist of the performance of the same steps in the reverse order with the final closing phase comprising the movement of the valve member from the position shown in broken lines back to the position shown in solid lines under the influence of spring 202 after the release of the hydraulic pressure in cylinder 208.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A charging installation for a pressurized furnace, the furnace having an axis and an internal distributor which has its receiving end aligned with the said axis, the furnace further having a charge material supply opening which is coaxial with said axis, said charging installation comprising:

an intermediate charge material storage vessel, said vessel having an axis, said vessel further having a discharge opening at its lower end and a loading opening in its upper end, said discharge opening being coaxial with said vessel;

means supporting said vessel above and coaxially with the furnace; and means for coupling said vessel discharge opening to the furnace to selectively establish a flow of charge material from the said vessel to the receiving end of the furnace distributor, said coupling means including flow control means, said flow control means defining a variable area orifice which is generally symmetrical with respect to a prolongation of the furnace axis, said flow control means comprising:

a pair of registers, said registers each having the shape of a segment of a sphere, said registers each also being provided with a cut-out extending inwardly from an edge thereof;

means supporting said registers for rotation about a common axis; and means for simultaneously imparting rotation in opposite directions about said axis to said registers whereby said cut-out portions of said registers may be placed in registration, said registered cut-out portions of said registers defining said variable area orifice;

said means supporting said registers for rotation comprising:

a common support shaft positioned to one side of a prolongation of said vessel discharge opening; and a pair of coaxial, rotatable support shafts positioned at the opposite side of said vessel discharge opening prolongation with respect to said common shaft, said coaxial shafts being coupled to respective of said registers and being rotatable relative to one another, said common and coaxial support shafts defining said common axis.

2. The apparatus of claim 1 wherein said coupling means further comprises:

a discharge conduit extending from said vessel discharge opening toward the furnace, said discharge conduit being coaxial with said vessel, said flow control means cooperating with the lower end of said discharge conduit.

3. The apparatus of claim 1 wherein said vessel defines a chamber and wherein said apparatus further comprises:

upper sealing valve means, said upper sealing valve means cooperating with said vessel loading opening to selectively hermetically seal said loading opening; and lower sealing valve means, said lower sealing valve means selectively hermetically sealing said vessel discharge opening whereby said vessel may be selectively pressurized and depressurized;

an open-topped hopper for receiving furnace charge material, said hopper having a discharge opening;

means supporting said hopper above said vessel with said hopper discharge opening in registration with said vessel loading opening; and retaining valve means, said retaining valve means cooperating with said hopper discharge opening to release material from said hopper into said vessel when said upper sealing valve means is in the open condition.

4. The apparatus of claim 1 wherein said charging installation further comprises:

a second vessel, said second vessel having a loading opening in one end thereof and a discharge opening in another end thereof;

means for supporting said second vessel above said intermediate storage vessel with said second vessel discharge opening in registration with said intermediate storage vessel loading opening;

upper sealing valve means for selectively hermetically sealing the loading opening of said second vessel;

lower sealing valve means for selectively hermetically sealing the discharge opening of said second vessel;

means for hermetically sealing said second vessel to said intermediate storage vessel; and retaining valve means, said retaining valve means cooperating with said second vessel discharge opening to selectively release material from said second vessel into said intermediate storage vessel.

5. The apparatus of claims 3 or 4 wherein said retaining valve means comprise:

a pair of registers, said registers each having the shape of a segment of a sphere;

means supporting said registers for rotation about a common axis; and means for simultaneously imparting rotation in opposite directions to said registers about said axis, said registers overlapping in the closed condition of said retaining valve means and being spacially displaced in the open condition of said retaining valve means.

6. The apparatus of claim 5 wherein said coupling means further comprises:

a discharge conduit extending from said intermediate storage vessel discharge opening, said discharge conduit being coaxial with said vessel, said flow control means cooperating with the lower end of said discharge conduit.

7. The apparatus of claim 3 wherein said sealing valve means each include a movable valve member which is in the shape of a segment of a sphere and wherein said lower sealing valve member is rotatable about an axis which lies in a horizontal plane with is approximately on the same level as the common axis of rotation of said registers.

8. The apparatus of claim 4 wherein said sealing valve means each include a movable valve member which is in the shape of a segment of a sphere.

9. The apparatus of claim 3 wherein said flow control means and said lower sealing valve means are supported within a common housing, said housing being removable with said flow control device and sealing valve as a unit and wherein said apparatus further comprises:

means hermetically sealing said common housing to said vessel and said furnace.

10. The apparatus of claim 9 wherein said sealing valve means and retaining valve means include each a valve member which is in the shape of a segment of a sphere and wherein said lower sealing valve member is rotatable about an axis which lies in a horizontal plane which is approximately on the same level as the axis of rotation of said registers.

11. The apparatus of claim 1 wherein said rotation imparting means comprises:

means defining a pair of parallel racks, said rack defining means being movable in a direction generally transverse to said common axis of rotation of said registers; and gear means affixed to each of said rotatable coaxial shafts, said gear means being engaged by respective of said parallel racks for simultaneous rotation in opposite directions in response to movement of said rack defining means.

12. The apparatus of claim 1 wherein said rotation imparting means comprises:

a rotatable shaft, said shaft being oriented generally transversely with respect to said common axis;

a pair of spacially displaced pinion gears mounted on said transversely oriented rotary shaft;

means for imparting rotation to said transversely oriented shaft; and gear means affixed to each of said rotatable coaxial shafts, said gear means being engaged by said pinion gears.

13. The apparatus of claims 3 or 4 wherein said sealing valve means each comprises:

a movable valve member, said valve member being in the form of a segment of a sphere; and means for causing said valve member to serially undergo motion in two directions during actuation, said two directions including a pivoting action about an axis passing through the center of curvature of said spherical segment and motion generally along a prolongation of the furnace axis.

14. The apparatus of claim 13 wherein said means for causing motion of said valve member comprises:

a tubular support having an axis, said support being mounted for rotation about its axis;

means coupling said tubular support to said valve member, said coupling means comprising:

a support arm, said support arm being affixed at a first end to said valve member;

means pivotally engaging said support arm intermediate its ends, said pivotal engaging means being affixed to said tubular support; and means for imparting longitudinal motion to the second end of said support arm, said longitudinal motion being along the axis of said tubular member and causing rotation of said support arm about said pivotal engaging means; and means for imparting rotation to said tubular member.

15. The apparatus of claim 13 wherein said means for causing motion of said valve members comprise:

a tubular support, said tubular support having an axis and being mounted for rotation about said axis;

fluidic actuator means disposed in said tubular support, said actuator means having an output member movable along said axis of said tubular support;

linkage means coupling the end of said actuator output member to said valve member;

means affixed to said tubular support for guiding the motion of said linkage means whereby said linkage means will move in a direction parallel to a prolongation of the furnace axis;

means for imparting rotation to said tubular support whereby said tubular support, fluidic actuator means, coupling means and motion guiding means will rotate as a unit about said tubular support axis to cause said valve member to rotate about said axis.

16. The apparatus of claim 15 wherein said fluidic actuator includes a piston and means for resiliently biasing said piston to a first position commensurate with said valve member being in the closed position, the delivery of pressurized fluid to said actuator overcoming said resilient bias and imparting motion to said piston, said piston motion being transmitted to said linkage means to impart motion thereto.

17. The apparatus of claim 13 wherein said means for causing motion of said valve members comprise:

a tubular support, said tubular support having an axis and being mounted for rotation about said axis;

a guide member, said guide member extending from said support in a direction generally transverse to said support axis;

fluidic actuator means disposed in said guide member, said actuator means having an output member movable in a direction generally transverse to said support axis;

a support arm coupling said actuator means output member to said valve member whereby said valve member will move in a first direction under the influence of said actuator means; and means imparting rotation to said tubular support.

18. The apparatus of claim 17 wherein said fluidic actuator includes a piston and means for resiliently biasing said piston to a first position commensurate with said valve member being in the closed position, the delivery of pressurized fluid to said actuator overcoming said resilient bias and imparting motion to said piston, said piston motion being transmitted to said support arm to impart motion thereto.

19. The apparatus of claim 1 wherein said vessel defines a chamber and wherein said apparatus further comprises:

upper sealing valve means, said upper sealing valve means cooperating with said vessel loading opening to selectively hermetically seal said loading opening; and lower sealing valve means, said lower sealing valve means selectively hermetically sealing said vessel discharge opening whereby said vessel may be selectively pressurized and depressurized;

an open-topped hopper for receiving furnace charge material, said hopper having a discharge opening;

means supporting said hopper above said vessel with said hopper discharge opening in registration with said vessel loading opening; and retaining valve means, said retaining valve means cooperating with said hopper discharge opening to release material from said hopper into said vessel when said upper sealing valve means is in the open condition.

20. The apparatus of claim 1 wherein said charging installation further comprises:

a second vessel, said second vessel having a loading opening in one end thereof and a discharge opening in another end thereof;

means for supporting said second vessel above said intermediate storage vessel with said second vessel discharge opening in registration with said intermediate storage vessel loading opening;

upper sealing valve means for selectively hermetically sealing the loading opening of said second vessel;

lower sealing valve means for selectively hermetically sealing the discharge opening of said second vessel;

means for hermetically sealing said second vessel to said intermediate storage vessel;

retaining valve means, said retaining valve means cooperating with said second vessel discharge opening to selectively release material from said second vessel into said intermediate storage vessel.

21. The apparatus of claim 19 or 20 wherein said sealing valve means comprises:

a movable valve member, said valve member being in the form of a segment of a sphere; and means for causing said valve member to serially undergo motion in two directions during actuation, said two directions including a pivoting action about an axis passing through the center of curvature of said spherical segment and motion generally along a prolongation of the furnace axis.

* * * * *